United States Patent [19]

Kude

[11] Patent Number: 4,986,184

[45] Date of Patent: Jan. 22, 1991

[54] SELF-STERILIZING FIRE-ON-THE-FLY BI-STABLE SAFE AND ARM DEVICE

[75] Inventor: William B. Kude, Plymouth, Minn.

[73] Assignee: Honeywell Inc., Minneapolis, Minn.

[21] Appl. No.: 426,923

[22] Filed: Oct. 26, 1989

[51] Int. Cl.[5] ..... F42C 15/24; F42C 15/34

[52] U.S. Cl. ..... 102/256; 102/244; 102/247

[58] Field of Search ..... 102/247, 251, 254, 256, 102/259, 244, 235, 229, 223

[56] References Cited

U.S. PATENT DOCUMENTS

| | | | |
|---|---|---|---|
| 2,960,037 | 11/1960 | Raech et al. | 102/251 |
| 4,128,061 | 12/1978 | Kaiser | 102/251 |
| 4,407,201 | 10/1983 | Jensen | 102/256 |
| 4,679,503 | 7/1987 | Rüdenauer et al. | 102/254 |
| 4,727,809 | 3/1988 | Watson | 102/254 |
| 4,848,235 | 7/1989 | Postler et al. | 102/256 |
| 4,854,239 | 8/1989 | Van Sloun | 102/229 |

*Primary Examiner*—David H. Brown
*Attorney, Agent, or Firm*—Roger W. Jensen

[57] ABSTRACT

A safe and arm device for aligning elements of an energy transfer mechanism of an ammunition fuze includes an inertial mass, an energy transfer mechanism interrupt barrier component and an energy-loadable spring, all movably mounted in a bore of a housing of the device. The inertial mass is movable for producing an arming force in response to application of a predetermined acceleration force to the housing. The bi-stable barrier component is movable from a pre-armed stable safe position to a post-armed stable sterilized position in response to the applying of the arming force to the component upon being released from its stable safe position. In moving to its stable sterilized position, the barrier component moves through an armed position in which the elements of the energy transfer mechanism are aligned in firing relation with one another during a momentary period of time. The energy-loadable spring interconnects the inertial mass and barrier component for storing the arming force produced by movement of the inertial mass and applying the arming force to the barrier component.

22 Claims, 2 Drawing Sheets

SELF-STERILIZING FIRE-ON-THE-FLY BI-STABLE SAFE AND ARM DEVICE

BACKGROUND OF THE INVENTION

1. Field of the Invention

The present invention generally relates to a fuze having an interrupted energy transfer mechanism and, more particularly, is concerned with a safe and arm device that incorporates a fire-on-the-fly bi-stable barrier component that does not stop in an armed position with parts of the energy transfer mechanism in alignment.

2. Description of the Prior Art

Fuzes are physical systems designed to sense a target or the result of other prescribed conditions such as time, barometric pressure, command, etc., and initiate a train of fire or detonation in an item of ammunition (warhead, projectile, bomb with an explosive charge, pyrotechnic, chemical or other load). Safing and arming are functions performed by a device in the fuze to preclude initiation of the ammunition before the desired position or time.

The primary purpose of the safe and arm device is to prevent an unintended functioning of a main charge explosive of the ammunition, but allowing an explosive train of the ammunition to function after arming. An explosive train is one form of an energy transfer mechanism. It begins with a primary explosive that initiates detonation, continues through a booster explosive that transmits and augments the detonation reaction and terminates in the main charge explosive that achieves the end destructive result of the ammunition.

In an interrupted-type explosive train, the primary explosive detonation is physically separated from the booster explosive by an interrupter or barrier component of the safe and arm device. The barrier component, typically a slider or rotor, interrupts the explosive path and thus prevents detonation of the booster and main charge explosive until arming occurs. Arming occurs by moving the explosive train barrier component to align the explosive elements in the explosive train of the fuze.

Military standards establish specific safety requirements applicable to safing and arming functions performed by such devices of fuzes intended for use with munitions. One of the safety requirements is that the barrier component of the safe and arm device interrupting the explosive train must be directly locked mechanically in the safe position by at least two independent safety features which cannot be removed until arming begins.

Another safety requirement is that if the fuze should misfire or malfunction, the design must preclude the possibility of the safe and arm device producing a potentially hazardous dud. A hazardous dud would be produced if the barrier component of the safe and arm device remaimed in the armed position with the elements of the explosive train in alignment.

Still another safety requirement is that the fuze should not utilize stored energy to provide the energy for arming unless adequate environmentally-derived energy is unavailable. A component contains stored energy if the component itself is capable of delivering energy in addition to the external energy required to initiate its function. Examples of components containing stored energy are compressed gases, explosive actuators and loaded springs.

SUMMARY OF THE INVENTION

The present invention provides a safe and ar device which meets these safety requirements as well as others specificed by military standards. The safe and arm device of the present invention offers increased safety over previous designs because of its unique fire-on-the-fly, bi-stable barrier component. The component effects fire on the fly by never stopping in the armed position with the parts of the energy transfer mechanism of the ammunition in alignment. The component is bistable in the sense that it is stable in either a prearmed position prior to alignment of the energy transfer mechanism or a post-armed self-sterilized position to which it moves immediately after a fire sequence is initiated.

The design of the present invention offers a greater margin of safety because the energy transfer mechanism is only in alignment for a very brief or momentary period of time during the fire sequence. If the fuze should misfire or malfunction, the design precludes the possibility of the safe and arm device remaining in the armed position with the parts of the energy transfer mechanism in alignment. The stabilized sterilized position of the device facilitates recovery of unused munitions.

Accordingly, the present invention is directed to a safe and arm device for aligning explosion-initiating elements of an energy transfer mechanism of an ammunition fuze. The safe and arm device includes: (a) means being movable for producing and storing an arming force in response to occurrence of a predetermined energy-generating event and for applying the arming force; and (b) a bi-stable energy transfer mechanism interrupt barrier component being movable from a prearmed stable safe position to a post-armed stable sterilized position in response to the applying of the arming force such that the component moves through an armed position in which the explosion-initiating elements of the energy transfer mechanism of the fuse are aligned in firing relation with one another during a momentary period of time.

More particularly, the arming force producing, storing and applying means includes an inertial mass and an energy-loadable means. The inertial mass is movable from an inactivated safe position to an activated safe position in response to occurrence of the energy-generating event for producing the arming force. The energy-loadable means is disposed between and interfaces with the inertial mass and barrier component for storing the arming force produced by movement of the inertial mass and applying the arming force to the barrier component. The energy-loadable means can be a resilient energy-storing spring. Before movement of the inertial mass, the energy-loadable means is in an unloaded condition wherein no arming force is stored nor applied to the barrier component. After movement of the inertial mass, the energy-loadable means is in a loaded condition wherein the arming force is stored and then applied to the barrier component for driving it through the armed position to the stable sterilized position.

Also, the safe and arm device includes first locking means and second locking means. The first locking means imposes a first lock condition on the barrier component to hold it at the stable safe position. The first locking means is operable in response to a first enabling event, occurring after occurrence of the energy-generating event, to release the first lock condition and permit the arming force applied on the barrier component to drive the component through the armed position to the stable sterilized position. The second locking means imposes a second lock condition on the barrier component upon arrival of the component at the stable sterilized position to hold it at such position.

Further, the safe and arm device includes a housing having a bore. The inertial mass, bi-stable barrier component and energy-loadable means are mounted for movement within the housing bore. The first and second locking means are mounted to the housing for movement between locking and releasing positions relative to the housing and the barrier component mounted therein for applying and withdrawing the first and second lock conditions to and from the barrier component.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
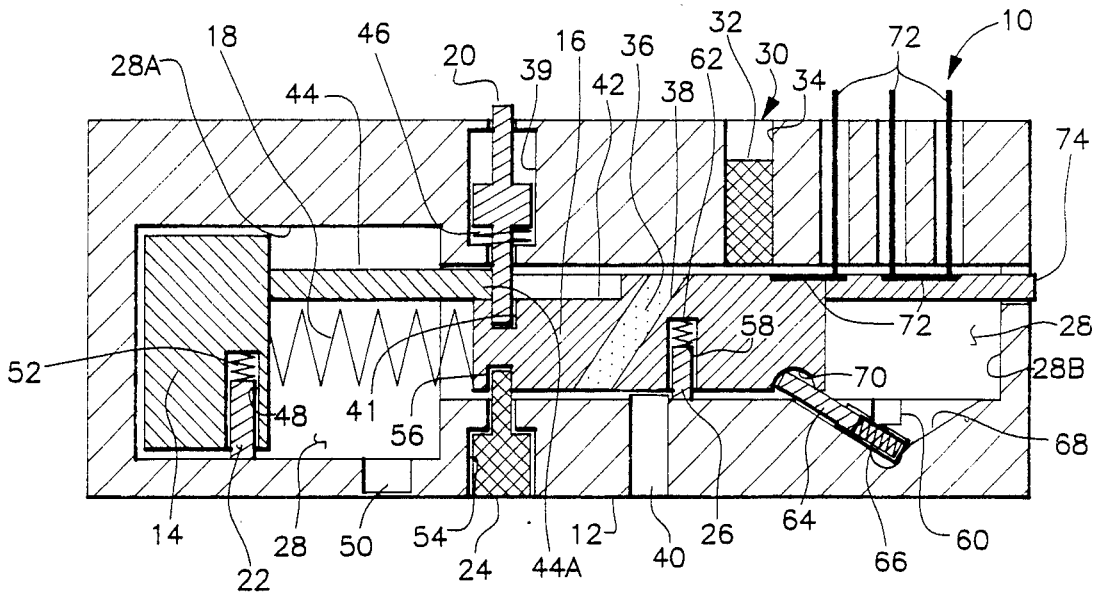
FIG. 1 is a schematic sectional view of a safe and arm device in accordance with the present invention, illustrating the device in a pre-launch safe condition.

Referring now to the drawings, and in particular to FIG. 1, there is shown a safe and arm device, generally designated by the numeral 10, for an ammunition fuze (not shown) which performs safing and arming functions in a manner which meets and surpasses military standards. In the illustrated embodiment, the safe and arm device 10 is particularly designed for application in a fuze to be used in a sublet of a munition called Wide Area Mine (WAM) submunition being developed for the U.S. military. However, the device 10 is adaptable for use to other applications.

Before describing in detail the arm and safe device 10 of the present invention, the WAM submunition will first be briefly described. The WAM (also termed a "smart" mine) submunition emplaced on the ground has a noise sensor that can detect the sounds, or acoustic signature, of a heavy vehicle, such as a tank, in a target area, for instance, of a 200 meter diameter circle around it. When the tank is detected in the target area, the WAM erects itself and launches the sublet from its cannister or laucher tube on a ballistics trajectory over the target (the tank). Then, a special chute is deployed which slows the sublet and places it in an inward spiraling descent over the target area with a scanner in the sublet scanning the area beneath the descending sublet until the target is located. Once the sublet has a fix on the target, a warhead detonates, sending an explosively-formed projectile into the target at a high velocity to achieve destruction of the target.

Turning now to FIG. 1, there is shown in schematic form the safe and arm device 10 of the fuze in the sublet. In its basic parts, the device 10 includes a housing 12, an inertial mass 14, a bi-stable barrier component 16, an energy loadable means 18 and a plurality of releasable safety locking elements 20–26. It will be apparent to one of ordinary skill in the art that the parts can be designed in many geometries and accommodate a variety of functional requirements and still operate in accordance with the principles of the present invention. For instance, the inertial mass 14 and barrier component 16 can be parts which move linearly or, alternatively, rotate relative to the housing 12". For purpose of promoting better comprehension of the present invention, a simplified linear representation of these parts of the device 10 are illustrated in FIGS. 1–4 which equally depicts either linear or rotational movements of the inertial mass 14 and barrier component 16 relative to the housing 12.

Figure 2:
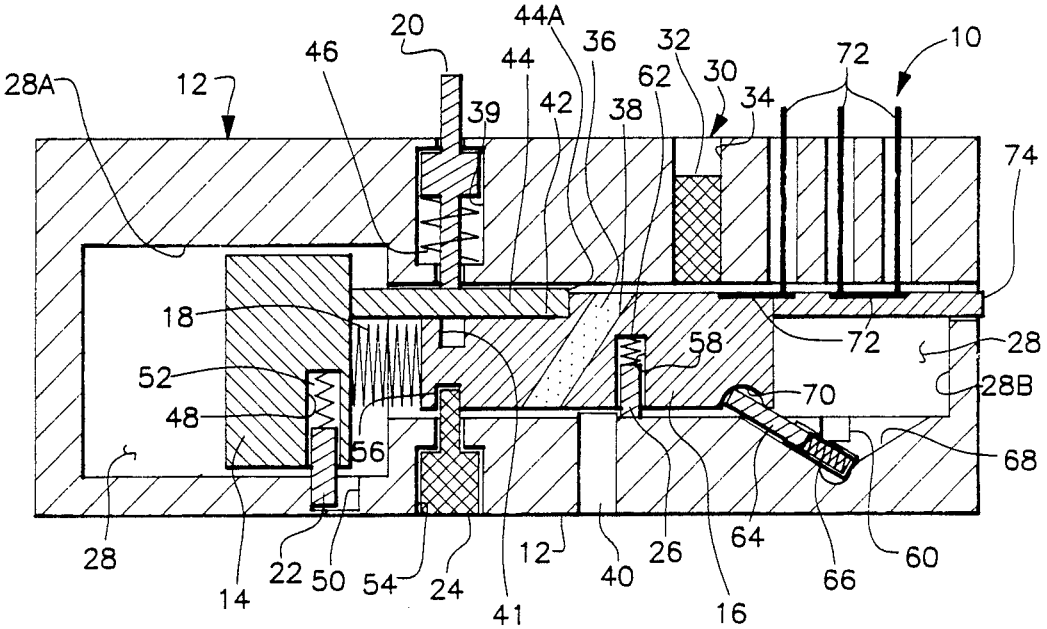
FIG. 2 is a schematic sectional view similar to FIG. 1, but illustrating the safe and arm device in a post-launch, activated safe condition.

More particularly, the housing 12 of the device 10 has an elongated bore 28. The inertial mass 14 of the device 10 is mounted in a larger diameter portion 28A of the bore 28 for reciprocatory movement axially of the bore 28 and along the housing 12 between an inactivated safe position, as seen in FIG. 1, and an activated safe position, as seen in FIG. 2. When the inertial mass 14 moves from its inactivated safe position (FIG. 1) to its activated safe position (FIG. 2) in response to a predetermined energy-generating event, occurring externally of the device 10, the mass 14 produces an arming force. In the one application of the device 10 mentioned above, the externally-occurring energy-generating event is an acceleration force of a predetermined magnitude applied to the housing 12 by sudden deceleration or slowing of the sublet upon deployment of the special parachute.

Figure 3:
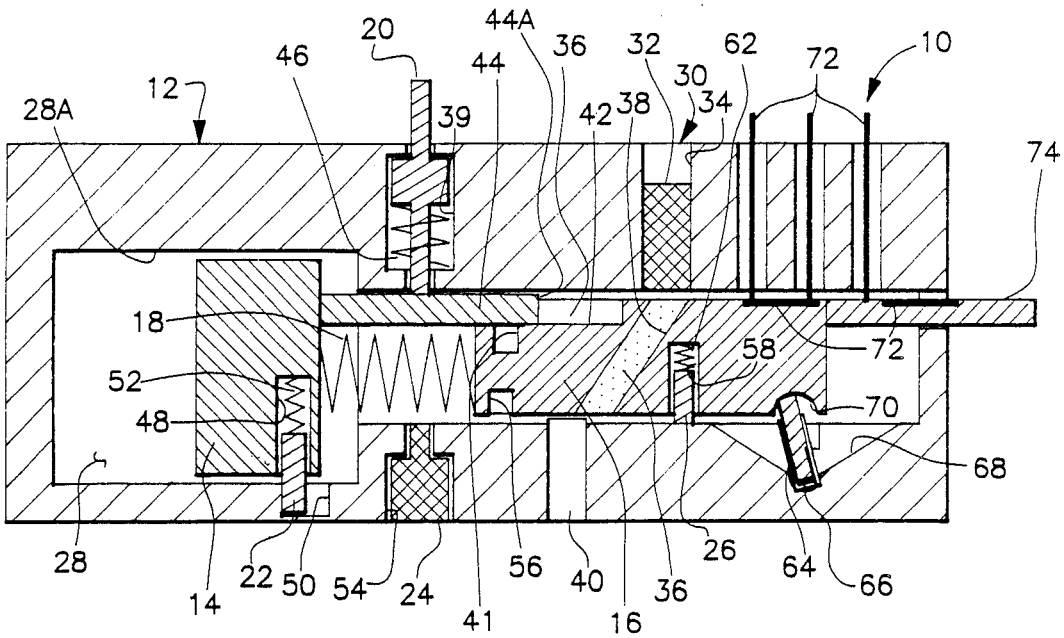
FIG. 3 is a schematic sectional view similar to FIG. 2, but illustrating the safe and arm device passing through a fire position.
Figure 4:
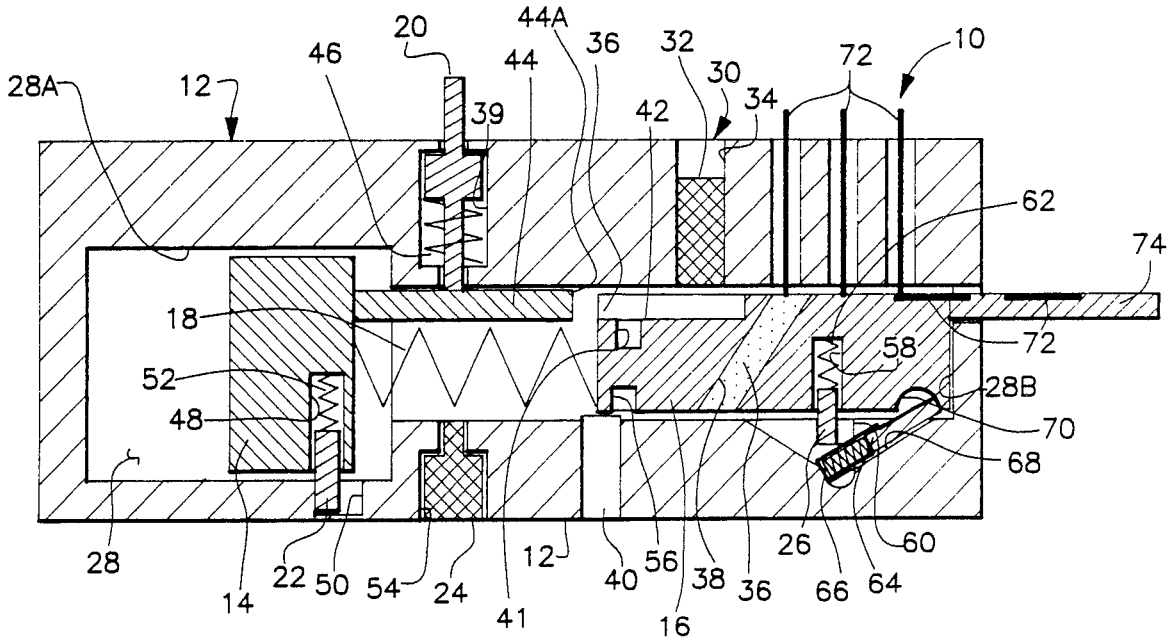
FIG. 4 is a schematic sectional view similar to FIG. 3, but illustrating the safe and arm device latched in a sterilized position.

The bi-stable barrier component 16 of the device 10 is mounted in a smaller diameter portion 28B of the housing bore 28 and adjacent to the inertial mass 14 being mounted in the larger diameter portion 28A thereof. The barrier component 16 is mounted for reciprocatory movement axially of the bore 28, along the housing 12 and relative to the inertial mass 14, from a pre-armed stable safe position, as seen in FIGS. 1 and 2, to a post-armed stable sterilized position, as seen in FIG. 4. As the barrier component 16 travels toward its stable sterilized position, it moves through an armed position being located intermediately between its extreme pre-armed and post-armed stable positions, as seen in FIG. 3, in which a plurality of elements or parts of an energy transfer mechanism, such as in the form of an explosive train 30 of the fuse, are aligned in a firing relation with one another during a brief, momentary predetermined period of time. The interval of time during which explosive train elements are aligned in the firing relation is much shorter than the time it takes the barrier component 16 to travel from its stable safe position (FIG. 2) to stable sterilized position (FIG. 4).

The portion of the explosive train 30 illustrated in FIGS. 1–4 is composed of three elements. The first element is a detonator 32 mounted in a slot 34 formed through one side of the housing 12 and open to the bore 28. The second element is a lead charge 36 mounted in a diagonal slot 38 open at its opposite ends and formed diagonally across the barrier component 16. The third element is a flash port 40 to a main charge explosive (not shown) formed through an opposite side of the housing 12 and open to the bore 28. As seen in FIGS. 1 and 2, when the barrier component 16 is at its stable safe position, the lead charge 36 carried by the barrier component is located upstream and offset from, or misaligned with, the detonator 32 and flash port 40 of the housing 12. As seen in FIG. 4, when the barrier component 16 is at its stable sterilized position, the lead charge 36 carried by the barrier component is located downstream and offset from, or misaligned with, the detonator 32 and flash port 40 of the housing 12. Only in the armed position shown in FIG. 3 is the lead charge 36 aligned with the detonator 32 and flash port 40.

The use of other forms of an energy transfer mechanism, instead of the explosive train 30, are possible. One form is a laser beam employed, in place of the detonator 32 and lead charge 36, in conjunction with the three alignable slots 34, 38, 40 in the housing 12 and barrier component 16 which when aligned permit passage of the laser beam through at the moment the barrier component 16 moves through the arming position.

The energy-loadable means 18 of the device 10 can take several different suitable forms. One form is a compressible gas filling the housing bore 28. Another form is a resilient energy-storing coil spring, as illustrated in FIGS. 1–4. The spring 18 is disposed in the housing bore 28 between the inertial mass 14 and barrier component 16 and for movement relative to the housing 12. The spring 18 interconnects the inertial mass 14 and barrier component 16 such that the spring 18 will be compressed and store the arming force produced by movement of the inertial mass 14 from its inactivated safe position (FIG. 1) to activated safe position (FIG. 2) as the barrier component 16 is held stationary at its stable safe position, seen in FIGS. 1 and 2. The stored arming force is then applied to the barrier component 16, but until the component is released from its stable safe position, application of the force does not result in movement of the component. Thus, before movement of the inertial mass 14, the spring 18 is in an unloaded condition wherein no arming force is stored nor applied to the barrier component 16 at the stable safe position. On the other hand, after movement of the inertial mass 14, the spring 18 is placed in a loaded condition wherein the arming force is now stored and then applied to the barrier component 16 for driving the latter from the stable safe position (FIGS. 1 and 2) through the armed position (FIG. 3) to the stable sterilized position (FIG. 4), upon release of the component 16 from being held at the stable safe position. It can be readily understood that a compressible gas filling the chamber 28 would function substantially the same as the spring 18.

The releasable safety lock elements are a bore-rider pin 20, an inertial mass locking pin 22, a piston actuator 24, and a barrier component locking pin 26. The bore-rider pin 20 is mounted within a cavity 39 in the housing 12 located radially outward from the housing bore 28. The pin 20 is movable toward and away from the barrier component 16 between locking and releasing positions for imposing, or applying, and withdrawing a lock condition to and from the barrier component 16 by mating or unmating with a lock cavity 41 thereof to hold the component at its stable safe position or to release the hold. When the pin 20 extends into the barrier component lock cavity 41, it also extends across a recess 42 defined in the barrier component 16 being aligned to slidably receive a projection 44 on the inertial mass 14. In so doing, the pin 20 blocks advancement of the projection 44 at a leading end 44A thereof into the barrier component recess 42 and thereby also applies the lock condition to the inertial mass 14 so as to hold it at its inactivated safe position. The pin 20 is biased by a spring 46 located in the housing cavity 39 to move radially outward in response to occurrence of a predetermined first enabling event to release the lock condition imposed on the inertial mass 14 and barrier component 16.

In the one application of the device 10 mentioned above, the first enabling event is launching the sublet carrying the fuze with the device 10. The tube of the launcher depresses the pin 20 against the spring 46 to the locking position seen in FIG. 1. As the sublet passes out the tube of the launcher, the pin 20 is released to the position seen in FIGS. 2–4. It will be noted that, as mentioned before, the elements of the explosive train 30 are also out of alignment. The first enabling event thus occurs before occurrence of the energy-generating event described earlier since the sublet must be launched before the special parachute is deployed to slow its trajectory.

The inertial mass locking pin 22 is mounted in a recess 48 in the inertial mass 14 for movement toward and away from the housing 12 between locking and releasing positions for applying and withdrawing a lock condition to and from the inertial mass. The locking pin 22 imposes the lock condition on the inertial mass 14 upon arrival of the inertial mass at its activated safe position (FIG. 2) to hold it at such position by insertion of the pin 22 into a locking hole 50 in the housing 12. The pin 22 is biased by a spring 52 disposed in the recess 48 for radial outward movement upon becoming aligned with the hole 50.

The piston actuator 24 is mounted in another cavity 54 in the housing 12 located radially outward from the housing bore portion 28B which mounts the barrier component 16. The piston actuator 24 is movable toward and away from the barrier component 16 between locking and releasing positions for applying and withdrawing a lock condition to and from the component. The inner end of the piston actuator 24 extends into a locking hole 56 in the barrier component 16 when imposing the lock condition on the barrier component to hold it at its stable safe position. The piston actuator 24 is withdrawn in response to occurrence of a second predetermined enabling event, being independent of the first enabling event and after the energy-generating event, to release the lock condition imposed on the component 16. In the one application of the device 10 mentioned above, the second enabling event is activation of the piston actuator 24 by either electrically-, mechanically- or explosively-driven means. The piston actuator 24 and the mode of actuation thereof is conventional per se and well known in the art and need not be illustrated nor described in detail for gaining a complete understanding of the invention. One suitable example of the piston actuator and its mode of actuation is illustrated and described in U.S. Pat. No. 4,854,239 to Van Sloun, which patent is assigned to the assignee of the present invention.

The barrier component locking pin 26 is mounted in a cavity 58 in the barrier component 16 for movement toward and away from the housing 12 between locking and releasing positions for applying and withdrawing a lock condition to and from the barrier component 16. The pin 26 extends into a locking hole 60 in the housing 12 for imposing the lock condition on the barrier component 16 upon its arrival at the stable sterilized position (FIG. 4) to hold it at such position. The pin 26 is biased by a spring 62 disposed in the cavity 58 for radial outward movement upon becoming aligned with the hole 60.

Also, the safe and arm device 10 includes an auxiliary force-producing mechanism in the form of a toggle pin 64 biased by a spring 66 and pivotally mounted to the housing 12 for rocking motion within a depression 68 therein. The inner end of the pin 64 engages with a semi-circular hole 70 in the barrier component for applying a biasing force on the barrier component when it is at both its stable safe position (FIGS. 1 and 2) and stable sterilized position (FIG. 4). In each location the force is directed away from the armed position (FIG. 3) of the component. As the barrier component 16 moves from its stable safe position (FIG. 2) toward its stable sterilized position (FIG. 4) through its armed position (FIG. 3), the spring 66 mounting the toggle pin 64 yields allowing the pin 64 to move outwardly as it pivots with the movement of the component 16.

It should be apparent that the timing between the release of the lock condition on the barrier component 16 by the piston actuator 24 and the firing of the detonator 32 when the component 16 reaches its armed position (FIG. 3) is critical if the device 10 is to successfully detonate the main charge explosive. Also, to summarize, when the bore-rider pin 20 has been released, the inertial mass 14 is then free to move when exposed to the acceleration force of the snatch load produced when the parachute opens. This movement provides or generates energy to compress the spring 18. Before that happens, the spring does not impose an arming force on the component 16.

Further, electrical contacts 72 can be provided to assist in the timing of the pulse to the detonator 32 to reduce the ambiguities of friction, age, and temperature that arise when trying to precisely determine the time between firing the piston actuator 24 and firing the main detonator 32 when the lead charge 36 is properly aligned therewith. If the detonator 32 does not fire, then a sterilization indicator pin 74 will be extended and can be observed. In this stable sterilized position (FIG. 4) of the barrier component 16, the explosive train 30 is not in alignment and the round is as safe to handle as it was in the position of FIG. 1.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having thus described the invention, what is claimed is:

1. In combination with an energy transfer mechanism of an ammunition fuze having first, second and third elements being alignable in a firing relation, a safe and arm device for aligning said elements of said energy transfer mechanism, said device comprising:

(a) a housing having a bore and mounting said first and third elements of said energy transfer mechanism in spaced positions adjacent said bore;

(b) means disposed and movable within said housing bore for producing and storing an arming force in response to occurrence of a predetermined energy-generating event and for applying said force; and (c) a bi-stable interrupt barrier component mounting said third element of said energy transfer mechanism and being disposed within said housing bore and movable from a pre-armed stable safe position to a post-armed stable sterilized position in response to applying of said arming force and through an armed position located between said pre-armed and post-armed positions in which said first, second and third elements of said energy transfer mechanism are aligned in said firing relation with one another during a momentary period of time.

2. The device of claim 1 further comprising: first locking means for imposing a first lock condition on said barrier component to hold it at said stable safe position and being operable in response to a first enabling event, occurring after occurrence of said energy-generating event, to release said first lock condition and permit said arming force applied on said barrier component to drive said component through said armed position to said stable sterilized position.

3. The device of claim 2 further comprising: second locking means for imposing a second lock condition on said barrier component upon arrival of said component at said stable sterilized position to hold it at such position.

4. The device of claim 3 wherein:

said first locking means is mounted to said housing for movement toward and away from said barrier component between locking and releasing positions for applying and withdrawing said first lock condition to and from said barrier component; and said second locking means is mounted to said barrier component for movement toward said housing to a locking position for applying said second lock condition to said barrier component.

5. The device of claim 1 wherein said arming force producing and storing means includes an inertial mass disposed within said housing bore and movable from an inactivated safe position to an activated safe position in response to occurrence of said energy-generating event for producing said arming force.

6. The device of claim 5 wherein said arming force producing and storing means further includes an energy-loadable means disposed within said housing bore between and interfaced with said inertial mass and said barrier component for storing said arming force produced by movement of said inertial mass and for applying on said barrier component such that before movement of said inertial mass said element is in an unloaded condition wherein no arming force is stored nor applied to said barrier component, whereas after movement of said inertial mass said element is in a loaded condition wherein said arming force is stored and then applied to said barrier component for driving said barrier component through said armed position to said stable sterilized position.

7. The device of claim 6 further comprising: a housing having a bore, said inertial mass, bistable barrier component and energy-loadable mean being disposed for movement within said housing bore.

8. The device of claim 6 wherein said energy-loadable means is a resilient energy-storing spring.

9. In combination with an energy transfer mechanism of an ammunition fuze having first, second and third elements being alignable in a firing relation, a safe and arm device for aligning said elements of said energy transfer mechanism, said device comprising:

(a) a housing having a bore and mounting said first and third elements of said energy transfer mechanism in spaced positions adjacent said bore;

(b) an inertial mass mounted in said bore for movement relative to said housing for producing an arming force in response to occurrence of a predetermined energy-generating event;

(c) a bi-stable interrupt barrier component mounting said third element of said energy transfer mechanism and being mounted in said bore adjacent to said inertial mass for movement relative to said housing and said inertial mass from a pre-armed stable safe position to a post-armed stable sterilized position in response to applying of said arming force and through an armed position located between said pre-armed and post armed positions in which said elements of said energy transfer mechanism are aligned in said firing relation with one another during a predetermined period of time; and (d) energy-loadable means disposed in said bore between and interfaced with said inertial mass and barrier component for storing said arming force produced by movement of said inertial mass and for applying said arming force on said component such that before movement of said inertial mass said energy-loadable means is in an unloaded condition wherein no arming force is stored nor applied to said barrier component at said stable safe position, whereas after movement of said inertial mass said energy-loadable means is in a loaded condition wherein said arming force is stored and then applied to said barrier component for driving said barrier component from said stable safe position through said armed position to said stable sterilized position.

10. The device of claim 9 wherein said inertial mass is mounted in said housing bore for movement from an inactivated safe position to an activated safe position in response to said energy-generating event.

11. The device of claim 10 wherein said energy-generating event is a predetermined acceleration force applied to said housing.

12. The device of claim 9 further comprising: first locking means for imposing a first lock condition on said barrier component to hold it at said stable safe position and being operable in response to a first enabling event, occurring after occurrence of said energy-generating event, to release said first lock condition and permit said arming force applied on said barrier component to drive said component through said armed position to said stable sterilized position.

13. The device of claim 12 further comprising: second locking means for imposing a second lock condition on said barrier component upon arrival of said component at said stable sterilized position to hold it at such position.

14. The device of claim 13 wherein said first locking means is respectively mounted to said housing for movement toward and away from said barrier component between locking and releasing positions for applying and withdrawing said first lock condition to and from said barrier component.

15. The device of claim 13 wherein said second locking means is respectively mounted to said barrier component for movement toward said housing to a locking position for applying said second lock condition to said barrier component.

16. In combination with an energy transfer mechanism of an ammunition fuze having first, second and third elements being alignable in a firing relation, a safe and arm device for aligning said elements of said energy transfer mechanism, said device comprising:

(a) a housing having a bore and mounting said first and third elements of said energy transfer mechanism in spaced positions adjacent said bore;

(b) an inertial mass mounted in said bore for movement from an inactivated safe position to an activated safe position for producing an arming force in response to a predetermined energy-generating event;

(c) a bi-stable interrupt barrier component mounting said third element of said energy transfer mechanism and being mounted in said bore adjacent to said inertial mass for movement relative to said housing and said inertial mass from a pre-armed stable safe position to a post-armed stable sterilized position in response to applying of said arming force and through an armed position located between said pre-armed and post armed positions in which said elements of said energy transfer mechanism are aligned in said firing relation with one another during a predetermined period of time; and (d) an energy-loadable resilient spring mounted in said bore for movement relative to said housing and interconnecting said inertial mass and barrier component for storing said arming force produced by movement of said inertial mass and for applying said arming force on said component such that before movement of said inertial mass said spring is in an unloaded condition wherein no arming force is stored nor applied to said barrier component at said stable safe position, whereas movement of said inertial mass said spring is in a loaded condition wherein said arming force is stored and then applied to said barrier component for driving said barrier component from said stable safe position through said armed position to said stable sterilized position; and (e) a plurality of releasable safety lock elements, a first of said safety lock elements for imposing a first lock condition on both said inertia mass and said barrier component to hold them at said respective inactivated safe position and stable safe position and being operable in response to occurrence of a first enabling event, being before occurrence of said energy-generating event, to release said first lock condition imposed thereon, a second of said safety lock elements for imposing a second lock condition on said inertial mass upon arrival of said inertial mass at said activated safe position to hold it at such position, a third of said safety lock elements for imposing a third lock condition on said barrier component to hold it at said stable safe position and being operable in response to occurrence of a second enabling event, being independent of said first enabling event and after said predetermined energy-generating event, to release said third lock condition imposed thereon, and a fourth of said safety lock elements for imposing a fourth lock condition on said barrier component upon arrival at said stable sterilized position to hold it at such position. third lock condition imposed thereon, and a fourth of said elements for imposing a fourth lock condition on said barrier component upon arrival at said stable sterilized position to hold it at such position.

17. The device of claim 16 wherein said first safety lock element is mounted to said housing for movement toward and away from said inertial mass and barrier component between locking and releasing positions for applying and withdrawing said first lock condition to and from said inertial mass and barrier component.

18. The device of claim 16 wherein said second safety lock element is mounted to said inertial mass for movement toward said housing to a locking position for applying said second lock condition to said inertial mass.

19. The device of claim 16 wherein said third safety lock element is mounted to said housing for movement toward and away from said barrier component between locking and releasing positions for applying and withdrawing said third lock condition to and from said barrier component.

20. The device of claim 16 wherein said fourth safety lock element is mounted to said barrier component for movement toward and away from said housing between locking and releasing positions for applying and withdrawing said fourth lock condition to and from said barrier component.

21. The device of claim 16 further comprising: an auxiliary force-producing mechanism pivotally mounted to said housing and engaged with said barrier component for applying a biasing force on said barrier component when said component is at both said stable safe position and stable sterilized position which force is directed away from said armed position of said component.

22. The device of claim 16 wherein said energy-generating event is a predetermined acceleration force applied to said housing.

* * * * *

UNITED STATES PATENT AND TRADEMARK OFFICE

CERTIFICATE OF CORRECTION

PATENT NO. : 4,986,184

DATED : January 22, 1991

INVENTOR(S) : William B. Kude

It is certified that error appears in the above-identified patent and that said Letters Patent is hereby corrected as shown below:

Column 10, line 35, after the word "whereas" insert --after--.

Column 10, line 65, through col. 11, line 2, cancel "third lock condition imposed thereon, and a fourth of said elements for imposing a fourth lock condition on said barrier component upon arrival at said stable sterilized position to hold it at such position.--.

Signed and Sealed this

Eighth Day of December, 1992

*Attest:*

*Attesting Officer*

DOUGLAS B. COMER

*Acting Commissioner of Patents and Trademarks*